US010239656B2

(12) United States Patent
Banik

(10) Patent No.: US 10,239,656 B2
(45) Date of Patent: Mar. 26, 2019

(54) BULK BIN SIDE WALL RETENTION

(71) Applicant: ORBIS Corporation, Oconomowoc, WI (US)

(72) Inventor: Joachim Banik, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 115 days.

(21) Appl. No.: 15/058,716

(22) Filed: Mar. 2, 2016

(65) Prior Publication Data

US 2016/0264289 A1 Sep. 15, 2016

Related U.S. Application Data

(60) Provisional application No. 62/130,944, filed on Mar. 10, 2015.

(51) Int. Cl.

| | |
|---|---|
| ***B65D 6/18*** | (2006.01) |
| ***B65D 21/08*** | (2006.01) |
| ***E05D 1/06*** | (2006.01) |
| ***E05D 7/10*** | (2006.01) |

(52) U.S. Cl.

CPC ..... *B65D 11/1833* (2013.01); *B65D 21/086* (2013.01); *E05D 1/06* (2013.01); *E05D 7/1061* (2013.01); *E05D 7/1077* (2013.01); *E05Y 2600/53* (2013.01); *E05Y 2900/602* (2013.01)

(58) Field of Classification Search

CPC ..... B65D 11/1833; B65D 21/086
USPC ..... 220/6
See application file for complete search history.

(56) References Cited

U.S. PATENT DOCUMENTS

| | | | | |
|---|---|---|---|---|
| 4,960,223 | A | 10/1990 | Chiang et al. | |
| 7,128,231 | B2 * | 10/2006 | Overholt ..... | B65D 11/1833 220/4.28 |
| 2009/0261092 | A1 | 10/2009 | Blanchard | |

FOREIGN PATENT DOCUMENTS

| | | | |
|---|---|---|---|
| DE | 9308051 | U1 | 6/2006 |
| EP | 3067288 | A1 | 9/2016 |
| WO | 2004043799 | A1 | 5/2004 |

OTHER PUBLICATIONS

European Patent Office, Extended European Search Report for European Application No. 16159512.9, dated Aug. 8, 2016 (9 pages).

European Patent Office, Communication under Rule 71(3) EPC—Intention to Grant issued in European Patent Application No. 16159512.9, dated Jan. 5, 2018, 6 pages.

* cited by examiner

*Primary Examiner* — Andrew T Kirsch
*Assistant Examiner* — Don M Anderson
(74) *Attorney, Agent, or Firm* — Greensfelder, Hemker & Gale, P.C.

(57) ABSTRACT

A bulk bin container having a retention clip for blocking both a first and second pin of a hinge axis element is provided. The container includes a generally rectangular base having one or more upward wall extensions along the edges of the base where each extension includes a plurality of hinge pockets for receiving a hinge axis element from the side walls. The retention clips connect to the base for blocking both the first hinge pin and the second hinge pin of the hinge axis element.

19 Claims, 7 Drawing Sheets

BULK BIN SIDE WALL RETENTION

CROSS-REFERENCE TO RELATED APPLICATIONS

The present invention claims the benefit of U.S. Provisional Patent Application No. 62/130,944 filed Mar. 10, 2015, the contents of which are incorporated herein by reference.

FEDERALLY SPONSORED RESEARCH OR DEVELOPMENT

N/A

FIELD OF THE INVENTION

The present invention is generally directed toward improved structure for retaining hinged side walls in a collapsible bulk bin container that does not utilize hinge rods; and more particularly to a bulk bin container having a retention clip for securing two hinge pins of a molded-in hinge axis of a side wall.

DESCRIPTION OF THE PRIOR ART

Plastic bulk bin containers typically consist of a base and four hingeably connected sidewalls. The side walls are in an approximately horizontal position when the bulk container is in a collapsed state, and in a vertical position when the container is erected to receive shipping goods. The side walls rotate about a hinge axis connecting the side wall to a base portion of the container.

Some containers have side walls connected to the base with a hinge rod that is alternatingly woven between components of the side wall and the base. These rods were subject to breaking and were difficult to install or remove when necessary.

Other containers have utilized rod-less hinge elements. However, separate structure was needed to retain the side wall to the base. Such structure required weakening of the hinge elements or related structure, or a number of pieces that required installation (and possible removal when necessary).

The present invention provides an improved structure for retaining a side wall in a rod-less container. The present invention is described below and shown in the Figures.

SUMMARY OF THE INVENTION

The present invention is directed to a bulk bin container with collapsible sidewalls having a retention clip for retaining a rod-less hinge element of a side wall to a base of the container. The retention clip is formed to have a first blocking segment and a second blocking segment. In this manner, a single clip can be used to block both bins of a hinge axis element.

In accordance with one embodiment of the invention, a collapsible bulk bin container with retention structure is provided. The container comprises a generally rectangular base having at least a first upward wall extension along a first edge of the base. The first upward wall extension includes at least a first hinge pocket for receiving a hinge axis from a side wall. The container also includes a first side wall having a first hinge axis extending from a bottom portion of the side wall. The first hinge axis includes a first hinge pin extending outward in a first direction and a second hinge pin extending outward in a second direction opposing the first direction. A first retention clip is connected to the base for blocking both the first hinge pin and the second hinge pin when the first hinge axis is positioned in the first hinge pocket of the first upward wall extension.

The retention clip includes a first blocking segment at a first end and a second blocking segment at a second end. The retention clip also includes an arm extending between the first blocking segment and the second blocking segment. Each of the blocking segments can be formed as horizontal ribs extending outward from the arm. The arm of the retention clip can include a flat, rectangular exterior portion suitable for a label or other decoration.

The first wall extension includes a first hole along a side of the first wall extension proximate a first end of the first hinge pocket to enable the first blocking segment to extend into an interior portion of the first hinge pocket. The wall also includes a second hole proximate a second end of the first hinge pocket to enable the second blocking segment to extend into the interior portion of the hinge pocket.

The retention clip can include a first hook extending outward from the first blocking segment for securing the retention clip to the first wall extension of the base. The first hook can be molded into the retention clip. Similarly, the retention clip can include a second hook extending outward from the second blocking segment. Preferably, the retention clip is formed from a flexible plastic or other similar material.

The first hinge pocket includes a first vertical pin groove on a first end and a second vertical pin groove on a second end. The first hinge pocket also includes a first slot proximate a top portion of the first vertical pin groove and a second slot proximate a top portion of the second vertical pin groove. The slots accommodate the blocking segments of the retention clip.

The first wall extension can include an outer groove for receiving the first retention clip. The groove can have a sufficient depth so that the retention clip does not extend outward from the first wall extension. The groove can be formed as a recession between outwardly extending ribs of the container.

The first blocking segment includes a first portion that extends inward from the arm when the retention clip is connected to the first wall extension of the base. The first blocking segment can also include a second portion extending perpendicular to the first portion of the first blocking segment toward the second blocking segment. Similarly, the second blocking segment can have similar structure.

In accordance with anther embodiment of the invention, a collapsible bulk bin with retention structure for retaining side walls having rod-less hinge elements is provided. The container comprises a base having a first wall extension along a first side, a second wall extension along a second side, a third wall extension along a third side and a fourth wall extension along a fourth side, each of the first, second, third and fourth wall extensions having a plurality of hinge pockets. The container also includes first, second, third and fourth side walls, each side wall having a plurality of hinge axes extending from a bottom portion of the side wall. Each hinge axis of the plurality of hinge axes having a molded-in first axis pin and a molded-in second axis pin. The container also includes a plurality of retention clips. Each retention clip blocks both the first hinge axis pin and the second hinge axis pin of one of the plurality of hinge axes in one of the side walls.

Further aspects of the invention are disclosed below and shown in the Figures.

BRIEF DESCRIPTION OF THE DRAWINGS

To understand the present invention, it will now be described by way of example, with reference to the accompanying drawings in which.

DETAILED DESCRIPTION

Figure 1:
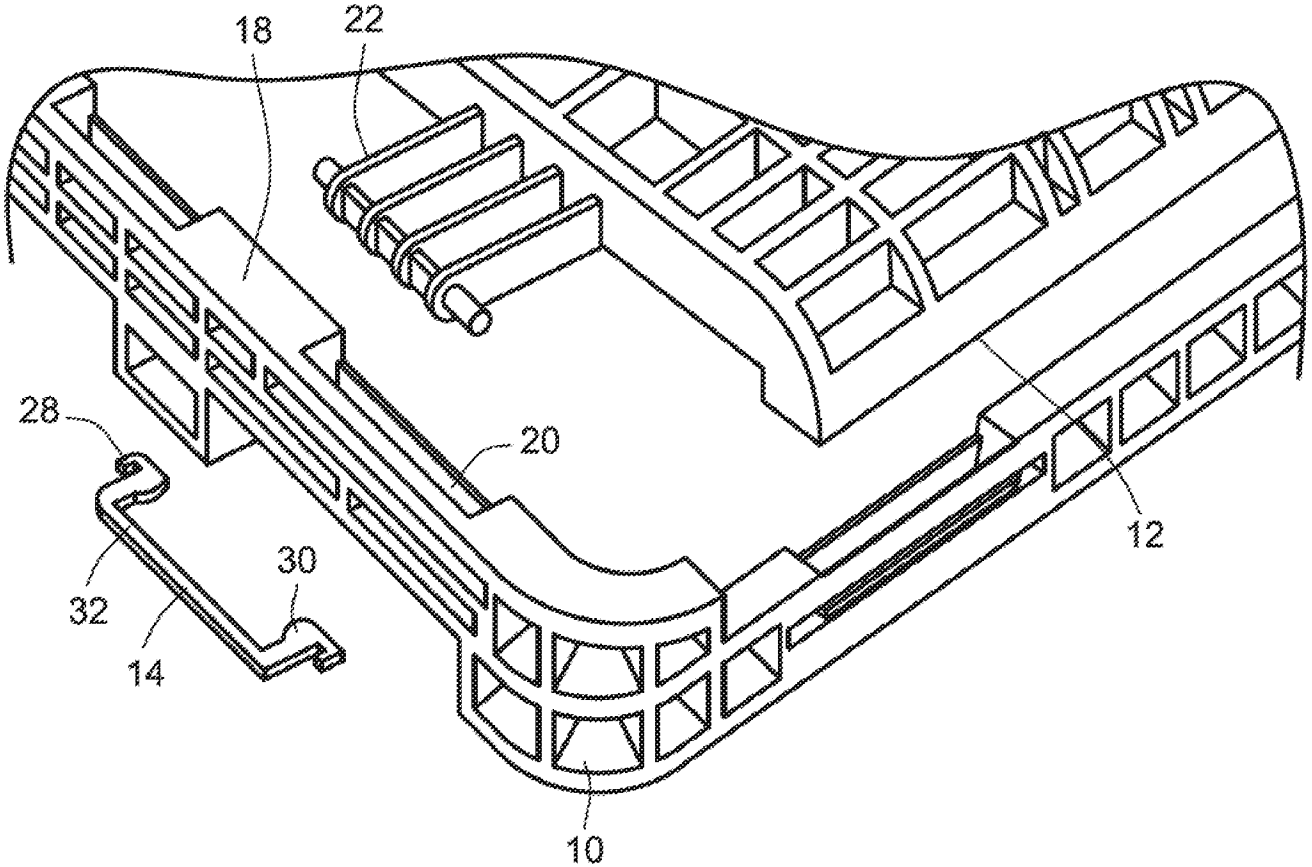
FIG. 1 is a perspective exploded view of a retention clip with a side wall and base portion in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention provides retention structure for holding a collapsible side wall to a base of a bulk bin container without the use of a hinge rod. The structure is used for side walls having molded-in axis elements that cooperate with structure in and/or connected to the base.

FIG. 1 provides a partial exploded view of a base 10 of a collapsible bulk bin, a side wall 12 and a retention clip 14 in accordance with the present invention (while the invention is described with respect to retaining a single side wall to the base, this description is applicable to each of the side walls). The base 10 has a generally rectangular bottom wall 16 (see e.g., FIG. 4), and partial walls (or wall extensions) extending upward from the side edges of the bottom wall 16. As shown in the Figure, a first wall extension 18 includes a hinge pocket 20 aligned with the retention clip 14 and a hinge axis element 22 of the side wall 12.

Figure 7:
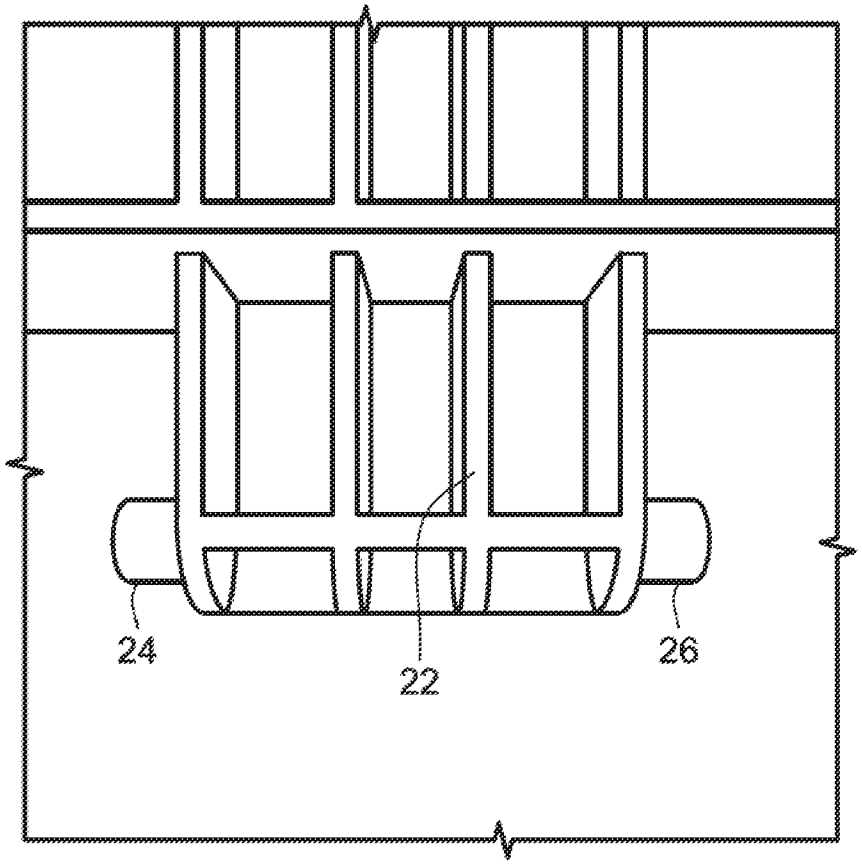
FIG. 7 is a close-up plan view of a molded-in hinge axis of a side wall for use with a collapsible bulk bin.

As shown in FIG. 7, the hinge axis element 22 includes a first molded-in pin 24 and a second molded-in pin 26 that forms an axis of rotation for the side wall 12. The side wall 12 can include a plurality of similar hinge axis elements (again, while the invention is described with respect to a retention of a single hinge axis element, the description is applicable to all of the hinge axis elements for each of the side walls). Because the pins 24, 26 are part of the hinge axis element 22, a separate hinge rod is not needed. Containers with this type of hinge system are sometimes referred to as rod-less containers.

Figure 2:
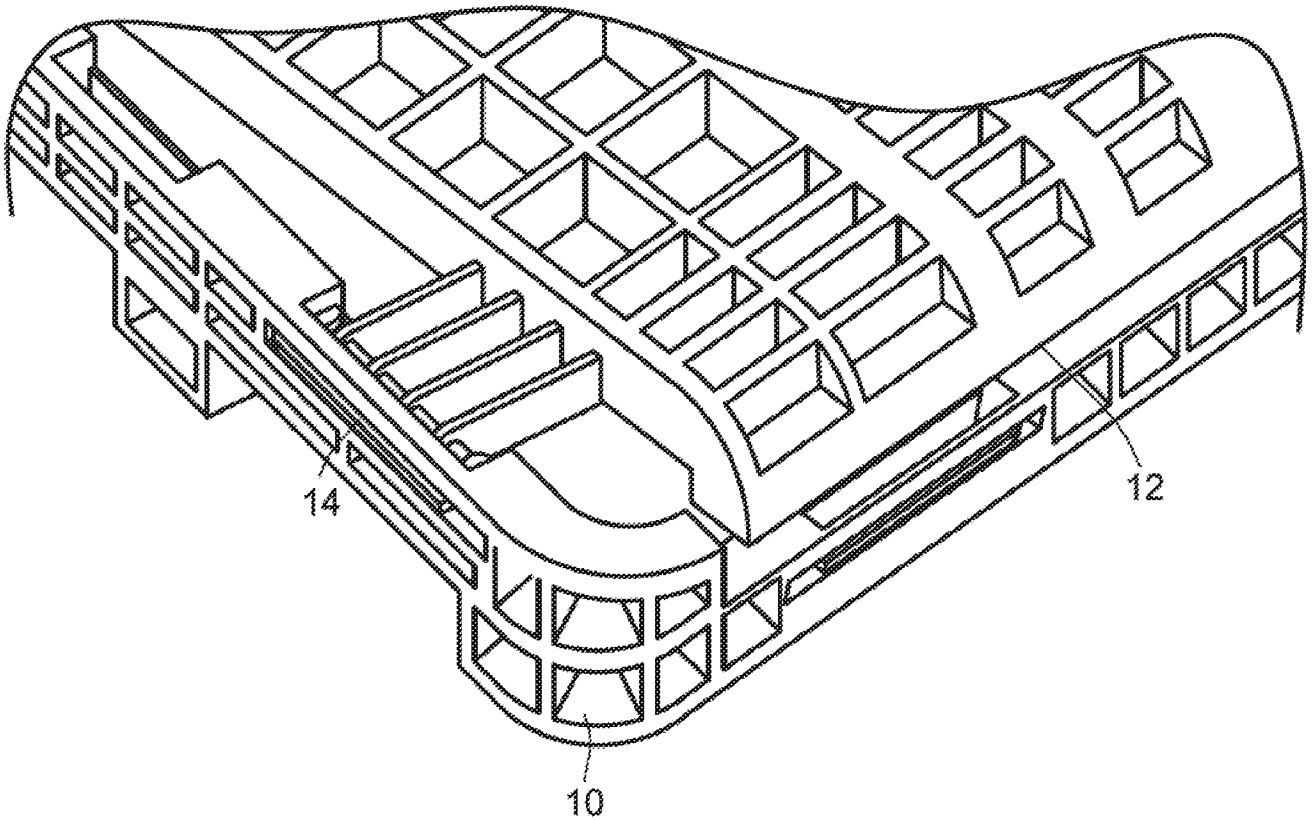
FIG. 2 is a perspective view of the side wall secured to the base portion with the retention clip.
Figure 3:
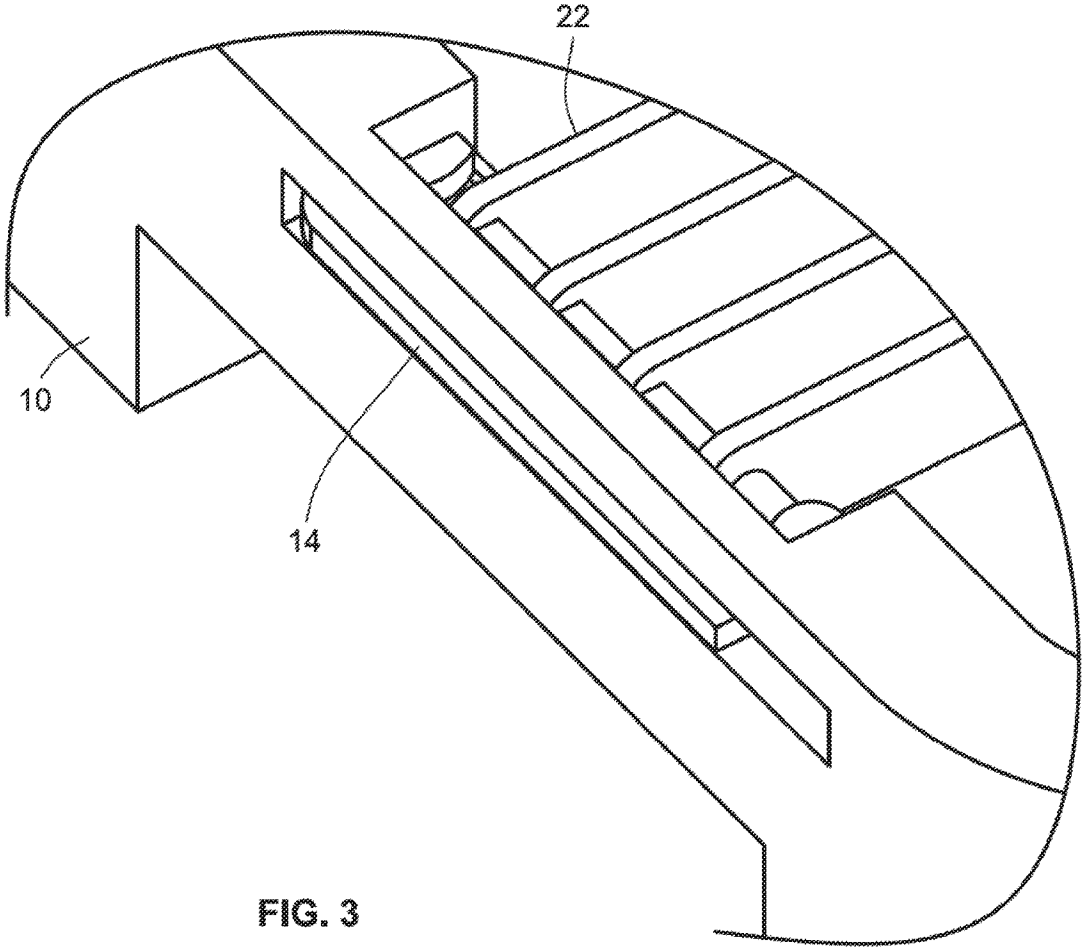
FIG. 3 is a close-up perspective view of the side wall, base portion and retention clip of FIG. 2.

The hinge axis element 22 fits into the hinge pocket 20, and the retention clip 14 connects to the wall extension 18 to block the hinge axis element 22 from disengaging from the hinge pocket 20 as shown in FIGS. 2 and 3. The retention clip 14 includes a first blocking segment 28 for blocking the first pin 24 and a second blocking segment 30 for blocking the second pin 26. A rectangular arm 32 connects the first and second blocking segments 28, 30. The blocking segments 28, 30 are each in the form of a horizontal rib extending from the ends of the arm 32.

Figure 4:
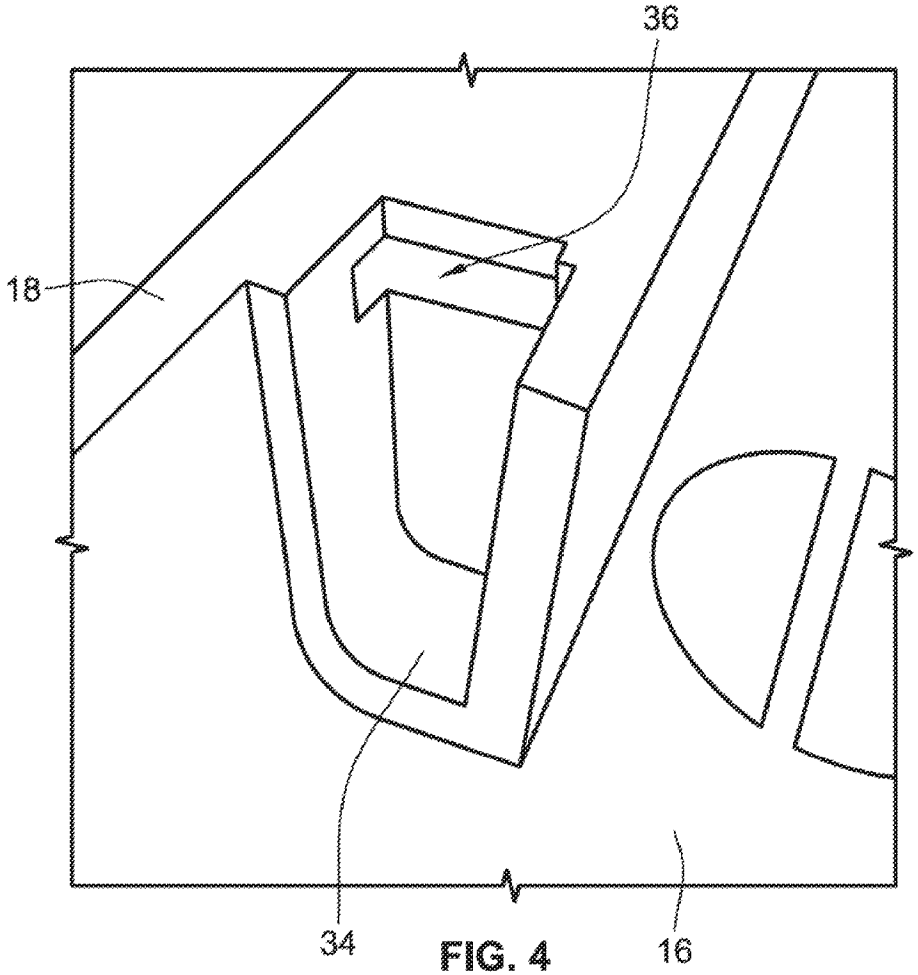
FIG. 4 is a perspective view of a pocket in the base portion for receiving a hinge of a side wall.

Referring to FIG. 4, the hinge pocket 20 has an open top and is open to the interior of the base 10. The hinge pocket 20 also includes a first vertical groove 34 on one end for the first pin 24 of the hinge axis element 22, and a second vertical groove on the opposite end for the second pin 26 of the hinge axis element 22. The vertical grooves for this hinge pocket 20 are long enough to allow the hinge axis element 22 (and thus the side wall 12) to float up and down in the grooves.

Associated with each groove is a slot 36 proximate the top of the groove that opens to the exterior of the wall extension 18. The slots 36 accommodate the first and second blocking segments 28, 30 of the retention clip 14.

In operation, once the pins 24, 26 of the hinge axis element 22 are inserted into the grooves 34 of the hinge pocket 20, the retention clip 14 is pressed into the outer surface of the wall extension 18 with blocking segments 28, 30 passing through the slot openings 36 into the interior of the hinge pocket 20. The outer surface of the wall extension 18 can have a groove (possibly formed as a space between outwardly projecting ribs) for accommodating the arm 32 of the clip 14.

Figure 5:
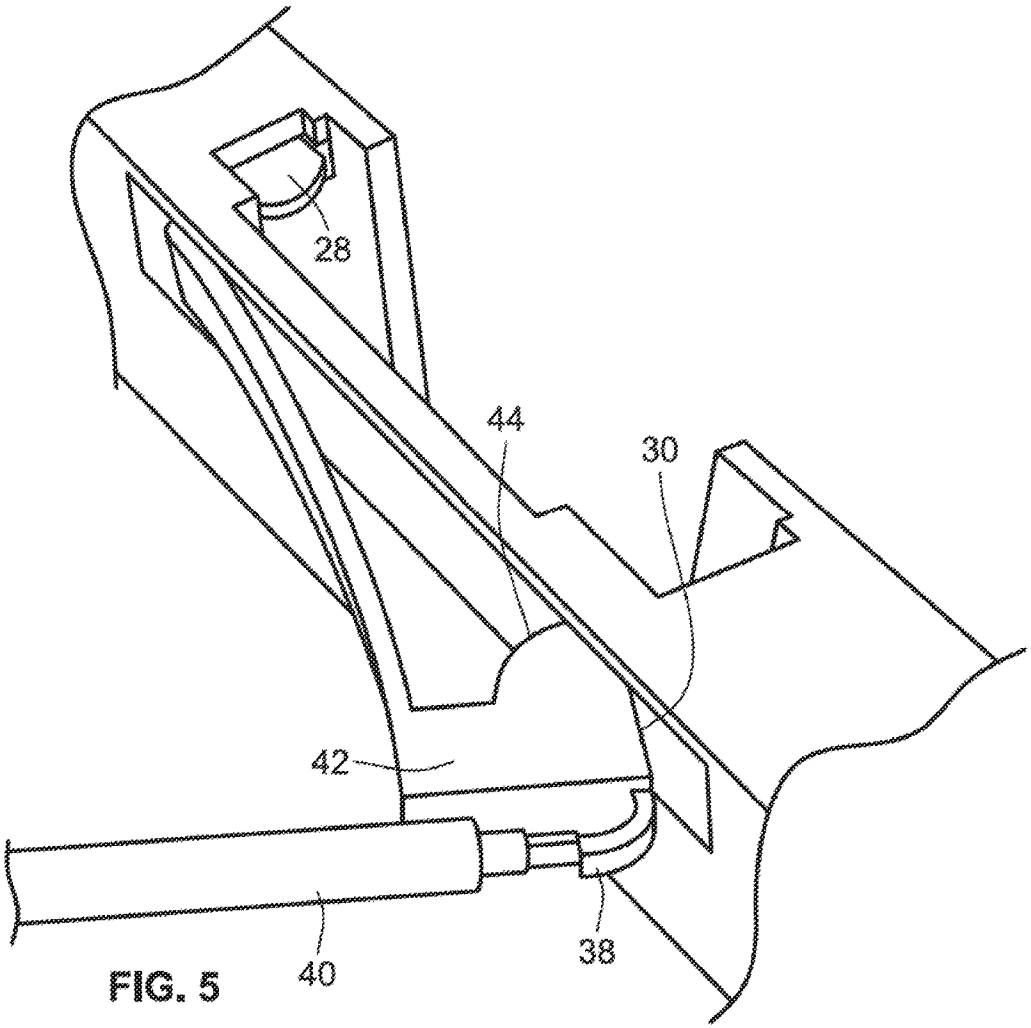
FIG. 5 is a perspective view of a retention clip being removed from a base portion.

As illustrated in FIG. 5, the retention clip 14 can include an outwardly extending hook or projection 38 that can be used to snap the retention clip 14 into place (a second hook can extend from the other end of the clip 14). As shown, a screwdriver 40 can be used to remove the retention clip 14 once in place. It is evident from this Figure that the retention clip 14 is preferably formed from a flexible material.

As also shown in FIG. 5, once inserted through the slot 36 the blocking extension 28 extends over the groove 34 to block any pin in the groove. The blocking segment 30 is shown having a first portion 42 extending inward and a second portion 44 (at the end of the first portion distal from the arm 32) extending perpendicular (into the groove) from the first portion.

Figure 6:
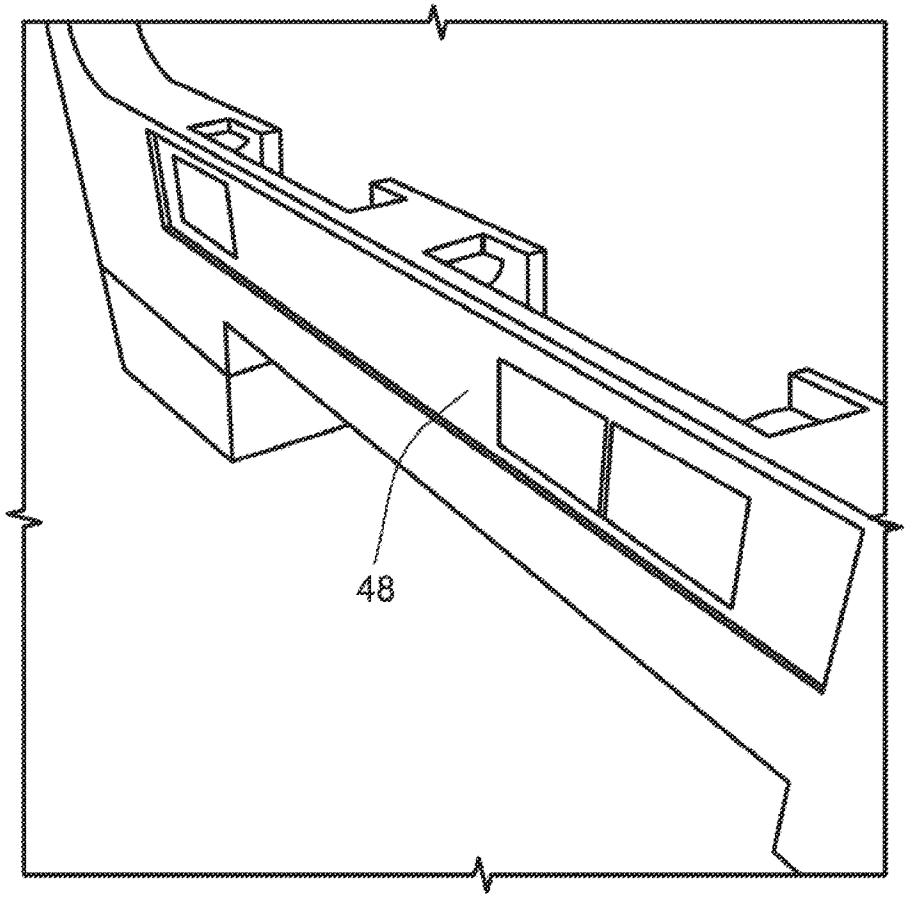
FIG. 6 is a perspective view of the retention clip in the base portion.

As illustrated in FIG. 6, the arm of the retention clip is preferably rectangular and includes space for a label 46.

Many modifications and variations of the present invention are possible in light of the above teachings. It is, therefore, to be understood within the scope of the appended claims the invention may be protected otherwise than as specifically described.

I claim:

1. A collapsible bulk bin container comprising:

a generally rectangular base having a first upward wall extension along a first edge of the base, the first upward wall extension having a first hinge pocket for receiving a hinge axis from a side wall;

a first side wall having a first hinge axis extending from a bottom portion of the side wall, the first hinge axis having a first hinge pin extending outward in a first direction and a second hinge pin extending outward in a second direction opposing the first direction;

a first removable retention clip connected to the base that blocks the first hinge pin when the first hinge axis is positioned in the first hinge pocket of the first upward wall extension, the first removable retention clip including an arm having a first end and extending to an opposing second end, the arm configured to form a portion of an outer surface of the first upward wall extension and a first blocking segment connected to the first end of the arm and extending inwardly from the outer surface of the first upward wall extension and a second blocking segment connected at the second end of the arm and extending inwardly from the outer surface of the first upward wall extension.

2. The collapsible bulk bin container of claim 1 wherein the first removable retention clip blocks the second hinge pin when the first hinge axis is positioned in the first hinge pocket of the first upward wall extension.

3. The collapsible bulk bin container of claim 2 wherein the arm, first blocking segment and second blocking segment of the removable retention clip form a generally C-shaped structure.

4. The collapsible bulk bin container of claim 1 wherein the arm of the removable retention clip includes a flat exterior portion suitable for a label.

5. The collapsible bulk bin container of claim 3 wherein the first blocking segment is a first horizontal rib extending from the first end of the removable retention clip and the second blocking segment is a second horizontal rib extending from the second end of the removable retention clip.

6. The collapsible bulk bin container of claim 5 wherein the first wall extension includes a first hole along a side of the first wall extension proximate a first end of the first hinge pocket to enable the first blocking segment to extend into an interior portion of the first hinge pocket and a second hole proximate a second end of the first hinge pocket to enable the second blocking segment to extend into the interior portion of the hinge pocket.

7. The collapsible bulk bin container of claim 3 wherein the removable retention clip includes a first hook extending outward from the first blocking segment for securing the removable retention clip to the first wall extension of the base.

8. The collapsible bulk bin container of claim 7 wherein the removable retention clip includes a second hook extending outward from the second blocking segment.

9. The collapsible bulk bin container of claim 2 wherein the first hinge pocket includes a first vertical pin groove on a first end of the first hinge pocket and a second vertical pin groove on a second end of the first hinge pocket.

10. The collapsible bulk bin container of claim 9 wherein the first hinge pocket includes a first slot proximate a top portion of the first vertical pin groove and a second slot proximate a top portion of the second vertical pin groove.

11. The collapsible bulk bin container of claim 1 wherein the first wall extension includes an outer groove for receiving the first retention clip, the groove having a sufficient depth so that the retention clip does not extend outward from the first wall extension.

12. The collapsible bulk bin container of claim 1 wherein the removable retention clip is formed from a flexible material.

13. The collapsible container of claim 1 wherein the first blocking segment includes a first portion that extends inward from the arm when the removable retention clip is connected to the first wall extension of the base.

14. The container of claim 13 wherein the first blocking segment includes a second portion extending perpendicular to the first portion of the first blocking segment toward the second blocking segment.

15. The container of claim 2 wherein the base portion includes a second hinge pocket in the first wall extension, the first side wall includes a second hinge axis extending from a bottom portion of the side wall, the second hinge axis having a first hinge pin extending outward in the first direction and a second hinge pin extending outward in the second direction, and a second removable retention clip for blocking both the first hinge pin and the second hinge pin of the second hinge axis when the second hinge axis is positioned in the second hinge pocket of the first upward wall extension.

16. A collapsible bulk bin container comprising:

a base having a first wall extension along a first side, a second wall extension along a second side, a third wall extension along a third side and a fourth wall extension along a fourth side, each of the first, second, third and fourth wall extensions having a plurality of hinge pockets;

a first side wall having a plurality of hinge axes extending from a bottom portion of the first side wall, each hinge axis of the plurality of hinge axes having a molded-in first axis pin and a molded-in second axis pin;

a second side wall having a plurality of hinge axes extending from a bottom portion of the second side wall, each hinge axis of the plurality of hinge axes having a molded-in first axis pin and a molded-in second axis pin;

a third side wall having a plurality of hinge axes extending from a bottom portion of the third side wall, each hinge axis of the plurality of hinge axes having a molded-in first axis pin and a molded-in second axis pin;

a fourth side wall having a plurality of hinge axes extending from a bottom portion of the fourth side wall, each hinge axis of the plurality of hinge axes having a molded-in first axis pin and a molded-in second axis pin; and, a plurality of removable retention clips, each removable retention clip blocking both the first hinge axis pin and the second hinge axis pin of one of the plurality of hinge axes in one of the side walls, each removable retention clip including an arm having a first end and extending to an opposing second end, the arm configured to form a portion of the outer surface of a one of the first, second, third and fourth extension walls, a first blocking segment connected to the first end of the arm and extending inward from the outer surface of the one extension wall and a second blocking segment connected at the second end of the arm and extending inwardly from the one extension wall.

17. The collapsible bulk bin container of claim 16 wherein arm, first blocking segment and second blocking segment of each removable retention clip forms a generally C-shaped structure.

18. The collapsible bulk bin container of claim 16 wherein the first blocking segment is a horizontal rib and the second blocking segment is a horizontal rib.

19. The collapsible bulk bin container of claim 18 wherein the arm is substantially rectangular and includes a first decorative side.

* * * * *